US009017492B2

(12) United States Patent
Sasai et al.

(10) Patent No.: US 9,017,492 B2
(45) Date of Patent: Apr. 28, 2015

(54) THIN GAUGE STEEL SHEET EXCELLENT IN SURFACE CONDITIONS, FORMABILITY, AND WORKABILITY AND METHOD FOR PRODUCING THE SAME

(75) Inventors: Katsuhiro Sasai, Futtsu (JP); Wataru Ohashi, Futtsu (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 216 days.

(21) Appl. No.: 12/806,971

(22) Filed: Aug. 24, 2010

(65) Prior Publication Data

US 2010/0319816 A1 Dec. 23, 2010

Related U.S. Application Data

(62) Division of application No. 10/578,218, filed as application No. PCT/JP2004/016691 on Nov. 4, 2004, now abandoned.

(30) Foreign Application Priority Data

Nov. 5, 2003 (JP) ..... 2003-375519

(51) Int. Cl.

| | |
|---|---|
| ***C21D 8/02*** | (2006.01) |
| ***C21C 7/064*** | (2006.01) |
| ***C21C 7/068*** | (2006.01) |
| ***C22C 38/00*** | (2006.01) |
| ***C22C 38/14*** | (2006.01) |
| *C21D 8/04* | (2006.01) |

(52) U.S. Cl.

CPC ..... *C21C 7/068* (2013.01); *C21C 7/064* (2013.01); *C21D 8/04* (2013.01); *C22C 38/004* (2013.01); *C22C 38/14* (2013.01)

(58) Field of Classification Search

USPC ..... 148/546, 603, 547, 320
IPC ..... C21D 8/0205; C22C 38/004
See application file for complete search history.

(56) References Cited

U.S. PATENT DOCUMENTS 5,045,404 A 9/1991 Ohmura et al.

FOREIGN PATENT DOCUMENTS

| | | | |
|---|---|---|---|
| EP | 0 829 546 | | 3/1998 |
| JP | 42-12348 | | 7/1967 |
| JP | 54-12883 | | 5/1979 |
| JP | 58-185752 | | 10/1983 |
| JP | 61-276756 | | 12/1986 |
| JP | 03-170618 | | 7/1991 |
| JP | 04-052229 | | 2/1992 |
| JP | 06-065647 | | 3/1994 |
| JP | 6065647 | | 3/1994 |
| JP | 06065647 | A * | 3/1994 |
| JP | 6-207244 | A | 7/1994 |
| JP | 06-212354 | | 8/1994 |
| JP | 06-271978 | | 9/1994 |
| JP | 08-218112 | | 8/1996 |
| JP | 8-239731 | A | 9/1996 |
| JP | 10-226843 | | 8/1998 |
| JP | 3137754 | B2 | 2/2001 |
| JP | 2003-105431 | A | 4/2003 |
| JP | 2003-268435 | | 9/2003 |
| JP | 2003-268435 | A | 9/2003 |
| JP | 2003268435 | A * | 9/2003 |
| WO | 01/57280 | | 8/2001 |
| WO | 03/002771 | A1 | 1/2003 |

OTHER PUBLICATIONS

T. Kizu, et al., "*Intergranular and internal oxidation during hot-rolling process in ultra-low carbon steel*," ISIJ International 42(2): 206-214 (2002).

N. Tsukamoto, et al., "*Prevention of alumina clogging in submerged entry nozzles*," Shinagawa Technical Report 44: 27-38 (2001).

N. Tsukamoto, et al., "*Prevention of alumina clogging in submerged entry nozzles for continuous casting*," Shinagawa Technical Report 41: 37-46 (1998).

European Supplementary Search Report dated Nov. 16, 2009, issued in corresponding European Patent Application No. 04799585.7.

Kachiro Saiki, "Effect of Annealing Condition on Deep Drawability of Cold Reduced Annealed Sheet" Journal of the Japan Society for Technology of Plasticity, vol. 9. No. 85 (Feb. 1968).

* cited by examiner

*Primary Examiner* — Weiping Zhu
(74) *Attorney, Agent, or Firm* — Kenyon & Kenyon LLP

(57) ABSTRACT

The present invention provides ultralow carbon thin gauge steel sheet and a method for producing the same where coalescence and growth of inclusions in the molten steel are prevented and the inclusions are finely dispersed in the steel sheet, whereby surface defects and cracks at the time of press forming are prevented, growth of recrystallized grains at the time of continuous annealing is promoted, and a high r value (r value≥2.0) and elongation (total elongation≥50%) are exhibited, that is, ultralow carbon thin gauge steel sheet excellent in surface conditions, formability, and workability comprised of, by mass %, 0.00030.003%≤C≤0.003%, Si≤0.01%, Mn≤0.1%, P≤0.02%, S≤0.01%, 0.0005%≤N≤0.0025%, 0.01%≤acid soluble Ti≤0.07%, acid soluble Al≤0.003%, and 0.002%≤La+Ce+Nd≤0.02% and a balance of iron and unavoidable impurities, said steel sheet characterized by containing at least cerium oxysulfite, lanthanum oxysulfite, and neodymium oxysulfite.

4 Claims, No Drawings

THIN GAUGE STEEL SHEET EXCELLENT IN SURFACE CONDITIONS, FORMABILITY, AND WORKABILITY AND METHOD FOR PRODUCING THE SAME

This application is a divisional application under 35 U.S.C. §120 and §121 of U.S. application Ser. No. 10/578,218 filed May 3, 2006, now abandoned which is a 35 U.S.C. §371 of PCT/JP04/16691 filed Nov. 4, 2004, which claims priority to Japanese Application No. 2003-375519 filed Nov. 5, 2003, which is incorporated by reference in its entirety.

TECHNICAL FIELD

The present invention relates to ultralow carbon thin gauge steel sheet excellent in workability and formability, good in surface conditions, and suitable as steel sheet used for press forming for automobiles, household electrical appliances, etc. and a method for producing the same.

BACKGROUND ART

In general, for automobiles, household electrical appliances, and other applications requiring excellent workability, for example, as disclosed in Japanese Patent Publication (B) No. 42-12348 and Japanese Patent Publication (B) No. 54-12883, ultralow carbon steel having a C concentration of 0.015 mass % or less and including Ti, Nb, and other strong carbide forming elements are being broadly used. Attempts have been made to further improve workability up to now by improving the method of production. Further, Japanese Patent Publication (A) No. 3-170618 and Japanese Patent Publication (A) No. 4-52229 propose steel sheet excellent in deep drawability, stretch formability, and other aspects of workability by increasing the sheet thickness in the final hot rolling or raising the hot rolled sheet coiling temperature. However, the problem has arisen that the increasing harshness of the hot rolling conditions increases the load on the heating furnace and hot rolling machine.

In the above ultralow carbon steel including Ti or Nb, fine carbides are present in the steel, so recrystallization is remarkably suppressed. For this reason, annealing at a high temperature becomes necessary. There are also issues such as the occurrence of heat buckling or sheet breakage during rolling and the increase in the amount of energy consumption. As opposed to this, as shown in Japanese Patent Publication (A) No. 6-212354 and Japanese Patent Publication (A) No. 6-271978, steel sheet with a low recrystallization temperature has been developed by setting suitable amounts of Mn and P in ultralow carbon steel not containing Nb or Ti and changing the hot rolling conditions. However, in these inventions, Mn or P is added in large amounts, so the alloy cost rises and therefore obtaining steel sheet for ultradeep drawing of a total elongation or 50% or more and a Lankford value (r value) of 2.0 or more is difficult. Further, ultralow carbon steel sheet usually is produced by deoxidizing by Al not yet deoxidized molten steel decarburized to the ultralow carbon range in a vacuum degassing system (RH) etc., that is, is "Al killed steel", so the molten steel contains a large amount of alumina inclusions. These alumina inclusions easily coalesce and join together in the molten steel and remain in the cast slab as large alumina clusters, so at the time of hot rolling and cold rolling, the alumina clusters become exposed at the steel sheet surface and cause surface defects. Further, when the alumina clusters remain inside the steel sheet, they become the cause of cracks, defects, and other flaws at the time of press forming. The formability also sharply falls.

In particular, in ultralow carbon steel, if the workability becomes better, the susceptibility to surface defects or cracks rises and even if going to the trouble of developing steel sheet with excellent workability, the yield obtained as a product is low and a large cost increase is incurred. To deal with these problems accompanying Al deoxidation, for example, as shown in Japanese Patent Publication (A) No. 61-276756 and Japanese Patent Publication (A) No. 58-185752, the method has been proposed of treating molten steel by Ca to convert the alumina clusters to low melting point calcium aluminate for quick removal by floatation. However, conversion of alumina clusters requires a large amount of Ca. It is known that Ca reacts with the S in the steel to form CaS and becomes a cause of rusting. Further, as shown in Japanese Patent Publication (A) No. 10-226843, the method has also been developed of adding fine amounts of Al and Ti for deoxidation and controlling the inclusions in the molten steel to inclusion compositions with good crushability mainly comprised of Ti oxides, Mn oxides, Si oxides, and alumina.

However, molten steel contains dissolved Al, so if the molten steel is reoxidized by the slag or air, the composition of titania-based inclusions caused by Ti deoxidation changes to the high alumina side and results in aggregation and coarsening, so this is not a fundamental resolution of the problems of surface defects and press defects. Further, the Mn oxides, Si oxides, and Ti oxides have to be made complex, but the upper limit value of the amount of addition of Ti is low, so there was the problem that a high workability material could not necessarily be obtained.

DISCLOSURE OF THE INVENTION

Therefore, the present invention has as its object to solve the above problems all at once and provide an ultralow carbon steel sheet free of press cracking and surface deterioration due to inclusions, exhibiting a high r value (r value≥2.0) and elongation (total elongation≥50%), and enabling good steelmaking operations and a method for producing the same.

Specifically, it has as its object to provide an ultralow carbon steel sheet produced not by Al deoxidation, but by Ti deoxidation to prevent the occurrence of the problems due to alumina-based inclusions and Al-based precipitates and by adding a suitable total amount of La, Ce, and Nd to prevent coalescence of titania-based inclusions at the time of Ti deoxidation, control precipitation of Ti-based precipitates, and prevent nozzle clogging in the steelmaking and thereby obtain the above properties. The present invention was made to solve the above problems and has as its gist the following:

(1) Ultralow carbon thin gauge steel sheet excellent in surface conditions, formability, and workability comprised of, by mass %, 0.0003%≤C≤0.003%, Si≤0.01%, Mn≤0.01%, P≤0.02%, S≤0.01%, 0.0005%≤N≤0.0025%, 0.01%≤acid soluble Ti≤0.07%, acid soluble Al≤0.003%, and 0.002%≤La+Ce+Nd≤0.02% and a balance of iron and unavoidable impurities, said steel sheet characterized by containing at least cerium oxysulfite, lanthanum oxysulfite, and neodymium oxysulfite.

(2) Ultralow carbon thin gauge steel sheet excellent in surface conditions, formability, and workability comprised of, by mass %, 0.0003%≤C≤0.003%, Si≤0.01%, Mn≤0.1%, P≤0.02%, S≤0.01%, 0.0005%≤N≤0.0025%, 0.01%≤acid soluble Ti≤0.07%, acid soluble Al≤0.003%, and 0.002%≤La+Ce+Nd0.02% and a balance of iron and unavoidable impurities, said steel sheet characterized in that an average grain size of recrystallized grains is 15 μm or more and an average value of an aspect ratio of the recrystallized grain size is 2.0 or less.

(3) Ultralow carbon thin gauge steel sheet excellent in surface conditions, formability, and workability as set forth in (1) or (2), characterized in that said thin gauge steel sheet further contains, by mass %, 0.0004%≤Nb≤0.05%.

(4) Ultralow carbon thin gauge steel sheet excellent in surface conditions, formability, and workability as set forth in any one of (1) to (3), characterized in that said thin gauge steel sheet further contains, by mass %, 0.0004%≤B≤0.005%.

(5) A method for producing ultralow carbon thin gauge steel sheet excellent in surface conditions, formability, and workability comprising casting molten steel comprised of, by mass %, 0.0003%≤C≤0.003%, Si≤0.01%, Mn≤0.1%, P≤0.02%, S≤0.0005%≤N≤0.0025%, 0.01%≤acid soluble Ti≤0.07%, acid soluble Al≤0.003%, and 0.002%≤La+Ce+Nd≤0.02% and a balance of iron and unavoidable impurities, heating the obtained cast slab, hot rolling and coiling it to obtain a hot rolled steel strip, cold rolling it by a cold rolling rate of 70% or more, then continuously annealing it during which recrystallization annealing it at 600 to 900° C.

(6) A method for producing ultralow carbon thin gauge steel sheet excellent in surface conditions, formability, and workability as set forth in (5), characterized in that said molten steel further contains, by mass %, 0.0004%≤Nb≤0.05%.

(7) A method for producing ultralow carbon thin gauge steel sheet excellent in surface conditions, formability, and workability as set forth in (5) or (6) characterized in that said molten steel further contains, by mass %, 0.0004%≤B≤0.005%.

BEST MODE FOR WORKING THE INVENTION

Below, the present invention will be explained in detail.

The inventors engaged in detailed research and analysis, taking note of the behavior of fine precipitates, on the method of promoting the recrystallization growth at the time of annealing in Ti-containing ultralow carbon steel so as to further improve the workability and as a result discovered that it is effective to limit the dissolved Al concentration (in analysis, corresponding to the acid soluble Al concentration, the "acid soluble Al concentration" meaning the measured amount of Al dissolved in an acid, the fact that dissolved Al will dissolve in an acid, while $Al_2O_3$ will not dissolve in an acid, being utilized in this method of analysis) to a predetermined value or less and to fix the S by at least La, Ce, and Nd. Here, "at least La, Ce, and Nd" means one or more types of La, Ce, and Nd.

Steel containing a large amount of dissolved Al produces some fine AlN. This AlN inhibits the recrystallized grain growth at the time of continuous annealing, so by limiting the acid soluble Al concentration to a predetermined value or less, the precipitation of AlN is prevented.

Further, regarding the S, by adding La, Ce, or Nd into the molten steel and fixing it as relatively large grain size (for example, several μm or more) lanthanum oxysulfite, lanthanum sulfite, cerium oxysulfite, cerium sulfite, neodymium oxysulfite, and neodymium sulfite inclusions, the solute S concentration in the cast slab is reduced. If reducing the solute S concentration in the cast slab, in the hot rolling process, the S can be prevented from precipitating as fine TiS (diameter of several 10 nm) and made to precipitate as the $Ti_4C_2S_2$ (diameter of several 100 nm) larger in grain size than TiS.

Further, before coiling the hot rolled sheet, the C in the steel sheet is also fixed as $Ti_4C_2S_2$, so the amount of precipitation of fine carbides (diameter of several 10 nm) precipitating at the time of coiling can be greatly reduced. That is, by adding at least La, Ce, and Nd, it is possible to enlarge the grain size of the precipitates in the Ti-containing ultralow carbon steel and possible to reduce the amount of the same. The pinning force falls, and the crystal grain growth at the time of continuous annealing is promoted. As a result, steel sheet excellent in workability exhibiting a high r value and a high elongation value can be obtained.

On the other hand, the inventors studied in detail the behavior of inclusions in the molten steel of the above composition and, by changing to deoxidation mainly by Ti, succeeded in the fine dispersion of inclusions and prevention of surface defects, cracks at the time of press forming, etc. From the viewpoint of the quality of the material, the acid soluble Al concentration has to be limited to a predetermined value or less and a state where substantively the molten steel does not contain any dissolved Al has to be secured, so the inventors came up with the idea of deoxidation by the Ti basically essential for quality. Normally, molten steel decarburized in a converter or vacuum treatment vessel contains a large amount of dissolved oxygen. This dissolved oxygen is usually almost entirely removed by the addition of Al (reacts as in the following formula (1)), so a large amount of $Al_2O_3$ inclusions are produced.

$$2Al+3O=Al_2O_3 \quad (1)$$

These inclusions coalesce and combine with each other directly after deoxidation to form large alumina clusters of several 100 μm or more size and cause surface defects and cracks at the time of press forming. Further, at the time of continuous casting, these alumina clusters deposit on the immersion nozzle. In serious cases, the nozzle ends up being completely clogged. However, in the present invention, the molten steel is mainly deoxidized by Ti, so the alumina clusters causing defects can be kept down to an extremely low limit and, as a result, surface defects and cracks at the time of press forming can be prevented and further clogging of the immersion nozzle can be suppressed. Further, even if slag or air etc. is entrained causing the molten steel to reoxidize, since substantively no dissolved Al is present, no new alumina inclusions are produced.

In the present invention, it is not necessary to remove all of the dissolved oxygen after decarburization by Ti alone. It is also possible to first perform preliminary deoxidation by Al to an extent where no dissolved Al substantively remains, stir the melt to cause the alumina-based inclusions to float up as coalesced clusters for removal to an extent preventing them from having any effect, then remove the oxygen remaining in the molten steel by Ti. Further, the molten steel is mainly deoxidized by Ti, so the inclusions in the molten steel become mainly Ti oxides. If continuously casting such molten steel, metal containing a high density of Ti oxides deposits on the inside walls of the ladle nozzle. In serious cases, the ladle nozzle ends up being completely clogged. The inventors discovered that if adding suitable quantities of La, Ce, and Nd, the Ti-based inclusions in the molten steel are converted to complex inclusions of at least La oxides, Ce oxides, and Nd oxides with Ti oxides (La oxide-Ti oxide, La oxide-Ce oxide-Ti oxide etc.) and become finely dispersed and form at least lanthanum oxysulfite, cerium oxysulfite, and neodymium oxysulfite to prevent clogging of the ladle nozzle and that if increasing the amounts of addition of La, Ce, and N, the oxysulfites change to sulfites and conversely clogging of the ladle nozzle is aggravated.

Therefore, by reducing the dissolved Al concentration to below a predetermined value, deoxidizing the molten steel mainly by Ti, and together adding suitable quantities of at least La, Ce, and Nd to the molten steel to convert the Ti oxides to complex oxides with the La oxides, Ce oxides, and Nd oxides and finely disperse them and causing the formation of at least lanthanum oxysulfite, cerium oxysulfite, and neodymium oxysulfite to fix the solute S, it is possible to prevent the clogging of the immersion nozzle and ladle nozzle and also produce thin gauge steel sheet excellent in surface conditions, formability and workability.

The chemical ingredients of the present invention were limited for the reasons explained below. Note that in the following explanation, the amounts of the ingredients are all mass %.

0.002%≤La+Ce+Nd≤0.02%: The La, Ce, and Nd in steel have the effect of improving the workability and of converting and finely dispersing the inclusions. With La+Ce+Nd<0.002%, it is not possible to convert and finely disperse Ti oxides and, further, it is not possible to fix the S in the molten steel as oxysulfites. Further, with La+Ce+Nd>0.02%, it is possible to form sulfites and fix the S, but the ladle nozzle ends up being clogged. Therefore, it is necessary to add the La, Ce, and Nd in the molten steel to obtain 0.002%≤La+Ce+Nd≤0.02%.

Acid soluble Al concentration≤0.003%: If the acid soluble Al concentration is high, the recrystallized grain growth at the time of continuous annealing falls and a large amount of alumina clusters is formed in the molten steel causing surface defects and cracks at the time of press forming, so a level where it is believed there is substantively no dissolved Al, that is, acid soluble Al concentration≤0.003%, is set. Further, the lower limit value of the acid soluble Al concentration includes 0%.

0.0003%≤C≤0.003%: If a large amount of C is present in the steel, even if working the present invention, at the time of coiling, a large amount of fine carbides precipitate and the pinning force increases, so crystal grain growth is inhibited and the workability ends up falling. For this reason, it is preferable to reduce the C concentration as much as possible, but for example if reducing the C concentration to less than 0.0003%, the vacuum degasification greatly increases in cost. Therefore, 0.003% is aimed at as the upper limit C concentration enabling the r value≥2.0 and the total elongation ≥50% of the present invention to be achieved and 0.0003% is aimed at as the lower limit C concentration below which the vacuum degasification greatly increases in cost.

Si≤0.01%: Si is an element useful for raising the strength of the steel, but conversely if the amount added becomes greater, the elongation and other aspects of the workability fall. Therefore, in the present invention, total elongation ≥50% was enabled by making the upper limit concentration of Si 0.01%. The lower limit value of Si concentration includes 0%.

Mn≤0.1%: If the Mn concentration becomes high, the workability falls, so to expect a high workability, specifically an r value≥2.0 and a total elongation≥50%, the upper limit value of the Mn concentration was made 0.1%. The lower limit value of Mn concentration includes 0%.

P≤0.02%: If P exceeds 0.02%, the workability is adversely affected and the r value≥2.0 and total elongation≥50% of the present invention can no longer be expected, so the upper limit value was made 0.02%. The lower limit value of P concentration includes 0%.

S≤0.01%: If S is too great, even if adding Ce or La, the S cannot be sufficiently fixed, so fine TiS is precipitated and recrystallized grain growth is obstructed. For this reason, the upper limit value of S was made 0.01%. The lower limit value of S concentration includes 0%.

0.0005≤N≤0.0025%: If N, like C, is present in a solute state, the workability of the steel sheet is degraded, so the amount is preferably reduced as much as possible, but for example reducing the N concentration to less than 0.0005% would lead to a drop in productivity or a large increase in refining costs, so the lower limit value of N was made 0.0005%. Further, if the N concentration is high, a large amount of Ti has to be added. Along with this, fine TiS ends up precipitating regardless of the addition of La or Ce, so the upper limit value of N was made 0.0025%.

0.01%≤acid soluble Ti≤0.07%: Ti is one of the most important elements in the present invention. Ti has to be added in an amount required for deoxidation of the molten steel and an amount for maintaining the above range of acid soluble Ti. Ti is added for the purpose of fixing the C and N degrading the workability and deoxidizing the molten steel, so must be present in the molten steel as dissolved Ti (in analysis, corresponding to the acid soluble Ti concentration, the "acid soluble Ti concentration" meaning the measured amount of Ti solute in an acid, the fact that dissolved Ti will dissolve in an acid, while $Ti_2O_3$ will not dissolve in an acid, being utilized in this method of analysis). If the acid soluble Ti concentration exceeds 0.07%, even if La, Ce is added, fine TiS ends up precipitating, while if the acid soluble Ti concentration becomes lower than 0.01%, the C and N in the steel sheet cannot be sufficiently fixed and the dissolved oxygen in the molten steel will also not fall, so the Ti concentration was made 0.01%≤acid soluble Ti≤0.07%.

0.004%≤Nb≤0.05%: Nb improves the workability, so is added to fix the C and N. If the amount of addition is less than 0.004%, the effect of improving the workability becomes smaller, while if the amount of addition is over 0.05%, the presence of the solute Nb conversely causes the workability to easily deteriorate, so the Nb concentration is preferably made 0.004%≤Nb≤0.05%.

0.0004%≤B≤0.005%: B is an element effective for preventing the embrittlement called "secondary work embrittlement" often seen when there is no longer solute C present at the crystal grain boundaries. It is added when the steel sheet of the present invention is used for parts which are subjected to extreme drawing etc. If the amount of addition is less than 0.0004%, the effect of prevention of secondary work embrittlement becomes smaller, while if over 0.005%, the recrystallization temperature becomes higher and other trouble easily occurs, so the amount of addition of B is preferably made 0.0004%≤B≤0.005%.

Next, the reasons for limitation of the production conditions will be explained. The continuously cast slab obtained from the above ingredients may be cooled once, reheated, then hot rolled or may be directly hot rolled directly without cooling. The temperature of the hot rolling, to cause as much $Ti_4C_2S_2$ as possible to precipitate, should be not more than 1250° C., preferably not more than 1200° C. In the present invention, C ends up precipitating almost entirely before coiling of the hot rolled sheet, so the coiling temperature has no effect on the amount of precipitation of fine carbides. The sheet should be coiled at usually from room temperature to about 800° C. in range. Coiling at less than room temperature not only results in excessive facilities, but also does not give any particular effect of improvement.

Further, if the coiling temperature exceeds 800° C., the oxide scale becomes thicker and invites an increase in the cost of pickling.

Next, the reduction rate in the cold rolling (called the "cold rolling rate") has to be at least 70% from the viewpoint of securing the workability. If the cold rolling rate is less than 70%, an r value of 2.0 or more cannot be secured.

The cold rolled steel sheet obtained after the cold rolling process is continuously annealed. The continuous annealing is performed at a temperature of 600 to 900° C. If less than 600° C., the steel does not recrystallize and the workability deteriorates, so 600° C. is made the lower limit, while if over 900° C., the steel sheet weakens in high temperature strength and problems arise such as the sheet breaking in the continuous annealing furnace, so 900° C. is made the upper limit. After this, skin pass rolling may be performed. Further, after this, the sheet may also be plated for corrosion resistance. The continuous annealing may be performed at the hot dip zinc coating line. It is also possible to hot dip coat the sheet immediately after annealing to obtain a hot dip zinc coated steel sheet, alloyed hot dip zinc coated steel sheet, etc.

The inventors investigated the recrystallized grains of the thus obtained high workability steel sheet in detail, whereupon they found it is possible to obtain steel sheet having an average circle equivalent diameter of recrystallized grains of 15 μm or more and an average value of the long axis/short axis of recrystallized grains (aspect ratio) of 2.0 or less. This is because the fine precipitates are reduced in number and the growth of the recrystallized grains is promoted.

When the average circle equivalent diameter of the recrystallized grains of the steel sheet is 15 μm or more, the total elongation is improved to 50% or more.

The upper limit is not particularly defined.

Further, when the average value of the long axis/short axis of recrystallized grains (aspect ratio) is 2.0 or less, the recrystallized grains approach spherical shapes and the r value is improved to 2.0 or more. Further, the lower limit value is not particularly defined, but the closer the crystallized grains to a spherical shape, the smaller the anisotropy, so the aspect ratio is preferably as close to 1 as possible.

EXAMPLES

Molten steel right after discharge from the converter was decarburized by a vacuum degasification system, then predetermined ingredients were added to thereby produce molten steel comprised of each of the ingredient compositions of Table 1. Each molten steel was continuously cast to obtain a cast slab which was heated to 1150° C., finish hot rolled at 930° C., and coiled at 700° C. to obtain a hot rolled sheet of a thickness of 4 mm. The obtained hot rolled sheet was cooled by a reduction rate of 80% (reduction rate=(initial sheet thickness−final sheet thickness)/initial sheet thickness×100), then continuously annealed at 780° C. and further skin pass rolled at a reduction rate of 0.7% to obtain the final product sheet. The obtained final product sheet was subjected to a tensile test and measured for r value using a No. 5 test piece described in JIS Z2201. The r value was calculated by measuring the values in the rolling direction (L direction), a direction perpendicular to the rolling direction (C direction), and a direction inclined 45° with respect to the rolling direction (D direction) and obtaining the average by the following equation:

$$r=(r_L+2r_D+r_C)/4$$

Each final product sheet was polished at the cross-section perpendicular to the rolling direction and examined for inclusions by the secondary electron image of a scan type electron microscope. EDX was used for analysis of the composition of about 50 randomly selected inclusions so as to determine the main inclusion composition. Further, the final product sheet was measured for the average circle equivalent diameter and average aspect ratio of the recrystallized grains by using a nital reagent to corrode the cross-section of the steel sheet in the rolling direction, obtaining a 500× to 1000× optical micrograph, then analyzing the image. The quality was evaluated by visual observation on the inspection line after cold rolling and assessing the number of surface defects occurring per coil.

The results of evaluation of the thus obtained steel sheets are shown in Table 2. As clear from Table 2, the steel sheets of the invention examples satisfying the requirements of the present invention (Steel Nos. 1 to 5) are steel sheets which have the solute S fixed as at least lanthanum oxysulfite, cerium oxysulfite, and neodymium sulfite inclusions, have average recrystallized grain sizes of 15 μm or more and aspect ratios of 2.0 or less, and are extremely good in grain growth, so exhibit high r values (r value≥2.0) and good total elongations (total elongation≥50%) and are improved in workability. Further, it is learned that the surface conditions are also extremely good in the invention examples (Steel Nos. 1 to 5) since almost no surface defects are formed. Further, in the invention examples (Steel Nos. 1 to 5), the Ti oxides in the molten steel are converted to complex oxides of at least La, Ce, and Nd oxides with Ti oxides, so there is also no clogging of the ladle nozzle or immersion nozzle and the operability at the time of continuous casting is also extremely good.

As opposed to this, in the steel sheets of the comparative examples (Steel Nos. 6 to 10), since La, Ce, and Nd are not added, no lanthanum oxysulfite, cerium oxysulfite, and neodymium sulfite inclusions are formed at all, a large amount of solute S remains, and steel sheets having average recrystallized grain sizes of less than 15 μm and aspect ratios of over 2.0 and poor in grain growth are obtained, so the r values (r value<2.0) and total elongations (total elongation<50%) are low and the workabilities are not improved. Further, regarding the surface conditions as well, in the comparative examples (Steel Nos. 6 to 9), since the inclusions are alumina, surface defects are formed. Further, in the comparative examples (Steel Nos. 6 to 9), the alumina in the molten steel deposits on the immersion nozzle and nozzle clogging occurs. In one comparative example (Steel No. 10), Ti oxides deposited on the ladle nozzle and the casting was interrupted.

TABLE 1

| | Ingredients (mass %) | | | | | | | | | | | |
|---|---|---|---|---|---|---|---|---|---|---|---|---|
| Steel no. | C | Si | Mn | P | S | N | Nb | B | Acid soluble Ti | Acid soluble Al | La + Ce + Nd | Remarks |
| 1 | 0.0025 | 0.008 | 0.09 | 0.018 | 0.009 | 0.0018 | | | 0.03 | 0.001 | 0.0025 | Inv. ex. |
| 2 | 0.0028 | 0.005 | 0.08 | 0.017 | 0.007 | 0.0024 | 0.012 | | 0.05 | 0.0015 | 0.01 | Inv. ex. |
| 3 | 0.0018 | 0.009 | 0.05 | 0.012 | 0.005 | 0.002 | | 0.0003 | 0.015 | 0.0025 | 0.018 | Inv. ex. |
| 4 | 0.0008 | 0.004 | 0.07 | 0.014 | 0.008 | 0.0022 | 0.025 | 0.0003 | 0.06 | 0.002 | 0.008 | Inv. ex. |
| 5 | 0.0012 | 0.003 | 0.05 | 0.008 | 0.009 | 0.0015 | | | 0.02 | 0.001 | 0.005 | Inv. ex. |
| 6 | 0.0025 | 0.008 | 0.09 | 0.018 | 0.009 | 0.0018 | | | 0.03 | 0.038 | tr | Comp. ex. |

TABLE 1-continued

| Steel no. | Ingredients (mass %) C | Si | Mn | P | S | N | Nb | B | Acid soluble Ti | Acid soluble Al | La + Ce + Nd | Remarks |
|---|---|---|---|---|---|---|---|---|---|---|---|---|
| 7 | 0.0028 | 0.005 | 0.08 | 0.017 | 0.007 | 0.0024 | 0.012 | | 0.05 | 0.04 | tr | Comp. ex. |
| 8 | 0.0018 | 0.009 | 0.05 | 0.012 | 0.005 | 0.002 | | 0.0003 | 0.015 | 0.035 | tr | Comp. ex. |
| 9 | 0.0008 | 0.004 | 0.07 | 0.014 | 0.008 | 0.0022 | 0.025 | 0.0003 | 0.06 | 0.04 | tr | Comp. ex. |
| 10 | 0.0012 | 0.003 | 0.05 | 0.008 | 0.009 | 0.0015 | | | 0.02 | 0.001 | tr | Comp. ex. |

TABLE 2

| Steel no. | r value | Total elongation (%) | Average recrystallized grain size (mm) | Average aspect ratio | Inclusion composition | No. of surface defects (/coil) | Remarks |
|---|---|---|---|---|---|---|---|
| 1 | 2.2 | 52 | 19 | 1.7 | Complex inclusions of La, Ce, Nd oxides and Ti oxides<br>Oxysulfites of La, Ce, and Nd | 0 | Inv. ex. |
| 2 | 2.1 | 51 | 17 | 1.9 | Complex inclusions of La, Ce, Nd oxides and Ti oxides<br>Oxysulfites of La, Ce, and Nd | 0 | Inv. ex. |
| 3 | 2.4 | 54 | 20 | 1.6 | Complex inclusions of La, Ce, Nd oxides and Ti oxides<br>Oxysulfites of La, Ce, and Nd | 0 | Inv. ex. |
| 4 | 2.5 | 56 | 22 | 1.4 | Complex inclusions of La, Ce, Nd oxides and Ti oxides<br>Oxysulfites of La, Ce, and Nd | 0 | Inv. ex. |
| 5 | 2.4 | 55 | 21 | 1.5 | Complex inclusions of La, Ce, Nd oxides and Ti oxides<br>Oxysulfites of La, Ce, and Nd | 0 | Inv. ex. |
| 6 | 1.7 | 45 | 9 | 2.4 | Alumina-based inclusions | 5.2 | Comp. ex. |
| 7 | 1.6 | 44 | 8 | 2.5 | Alumina-based inclusions | 7.3 | Comp. ex. |
| 8 | 1.8 | 46 | 10 | 2.3 | Alumina-based inclusions | 6.2 | Comp. ex. |
| 9 | 1.9 | 48 | 14 | 2.1 | Alumina-based inclusions | 5.6 | Comp. ex. |
| 10 | 1.8 | 47 | 13 | 2.1 | Ti oxide-based inclusions | 0 | Comp. ex. |

INDUSTRIAL APPLICABILITY

According to the present invention, the inclusions in the molten steel can be finely dispersed, so clogging of the immersion nozzle and ladle nozzle is suppressed, surface defects and cracks at the time of press forming can be prevented, and recrystallized grain growth at the time of continuous annealing can also be promoted, so low carbon thin gauge steel sheet excellent in workability and formability can be produced.

The invention claimed is:

1. A method for producing an ultralow carbon thin gauge steel sheet excellent in surface conditions, formability, and workability, the method comprising the steps of:

casting a molten steel consisting of, by mass %, 0.0003%≤C≤0.003%,

Si≤0.01%,

Mn≤0.1%,

P≤0.02%, 0.005%≤S≤0.01%, 0.0005%≤N≤0.0025%, 0.01%≤acid soluble Ti≤0.07%, acid soluble Al≤0.003%, and 0.002%≤La+Ce+Nd≤0.02%, and a balance of iron and unavoidable impurities, heating a cast slab obtained from the casting step, hot rolling and coiling the slab to obtain a hot rolled steel strip, cold rolling the steel strip at a cold rolling rate of 70% or more and then continuously annealing the cold-rolled steel strip at a recrystallization annealing temperature of 600 to 780° C., wherein the cold-rolled and annealed steel sheet has an r-value of 2.0 or more, and wherein the step of casting a molten steel comprises the successive steps of:

(a) adding Al to perform preliminary deoxidation of the molten steel;

(b) adding Ti to deoxidize the molten steel; and (c) adding one or more of La, Ce, and Nd to form complex oxides of La oxides, Ce oxides, and Nd oxides with Ti oxides, and one or more of cerium oxysulfite, lanthanum oxysulfite, and neodymium oxysulfite to fix the solute S in the molten steel, and (d) continuously casting.

2. A method for producing an ultralow carbon thin gauge steel sheet excellent in surface conditions, formability, and workability, the method comprising the steps of:

casting a molten steel consisting of, by mass %, 0.0003%≤C≤0.003%,

Si≤0.01%,

Mn≤0.1%,

P≤0.02%

0.005%≤S≤0.01%, 0.0005%≤N≤0.0025%, 0.01%≤acid soluble Ti≤0.07%, acid soluble Al≤0.003%, 0.002%≤La+Ce+Nd≤0.02%, and
0.0004%≤Nb≤0.05% and
a balance of iron and unavoidable impurities,
heating a cast slab obtained from the casting step,
hot rolling and coiling the slab to obtain a hot rolled steel strip,
cold rolling the steel strip at a cold rolling rate of 70% or more and then continuously annealing the cold-rolled steel strip at a recrystallization annealing temperature of 600 to 780° C.,
wherein the cold-rolled and annealed steel sheet has an r-value of 2.0 or more, and
wherein the step of casting a molten steel comprises the successive steps of:
(a) adding Al to 5 form preliminary deoxidation of the molten steel;
(b) adding Ti to deoxidize the molten steel; and
(c) adding one or more of La, Ce, and Nd to form complex oxides of La oxides, Ce oxides, and Nd oxides with Ti oxides, and one or more of cerium oxysulfite, lanthanum oxysulfite, and neodymium oxysulfite to fix the solute S in the molten steel, and
(d) continuously casting.

3. A method for producing an ultralow carbon thin gauge steel sheet excellent in surface conditions, formability, and workability, the method comprising the steps of:
casting a molten steel consisting of, by mass %,
0.0003%≤C≤0.003%,
Si≤0.01%,
Mn≤0.1%,
P≤0.02%,
0.005%≤S≤0.01%,
0.0005%≤N≤0.0025%,
0.0004%≤B≤0.005%,
0.01%≤acid soluble Ti≤0.07%,
acid soluble Al≤0.003%, and
0.002%≤La+Ce+Nd≤0.02%, and
a balance of iron and unavoidable impurities,
heating a cast slab obtained from the casting step,
hot rolling and coiling the slab to obtain a hot rolled steel strip,
cold rolling the steel strip at a cold rolling rate of 70% or more and then continuously annealing the cold-rolled steel strip at a recrystallization annealing temperature of 600 to 780° C.,
wherein the cold-rolled and annealed steel sheet has an r-value of 2.0 or more, and
wherein the step of casting a molten steel comprises the successive steps of:
(a) adding Al to perform preliminary deoxidation of the molten steel;
(b) adding Ti to deoxidize the molten steel; and
(c) adding one or more of La, Ce, and Nd to form complex oxides of La oxides, Ce oxides, and Nd oxides with Ti oxides, and one or more of cerium oxysulfite, lanthanum oxysulfite, and neodymium oxysulfite to fix the solute S in the molten steel, and
(d) continuously casting.

4. A method for producing an ultralow carbon thin gauge steel sheet excellent in surface conditions, formability, and workability the method comprising the steps of:
casting a molten steel consisting of, by mass %,
0.0003%≤C≤0.003%,
Si≤0.01%,
Mn≤0.1%,
P≤0.02%
0.005%≤S≤0.01%,
0.0005%≤N≤0.0025%,
0.0004%≤B≤0.005%,
0.01%≤acid soluble Ti≤0.07%,
acid soluble Al≤0.003%,
0.002%≤La+Ce+Nd≤0.02%, and
0.0004%≤Nb≤0.05%, and
a balance of iron and unavoidable impurities,
heating a cast slab obtained from the casting step,
hot rolling and coiling the slab to obtain a hot rolled steel strip,
cold rolling the steel strip at a cold rolling rate of 70% or more and then continuously annealing the cold-rolled steel strip at a recrystallization annealing temperature of 600 to 780° C.,
wherein the cold-rolled and annealed steel sheet has an r-value of 2.0 or more, and
wherein the step of casting a molten steel comprises the successive steps of:
(a) adding Al to perform preliminary deoxidation of the molten steel;
(b) adding Ti to deoxidize the molten steel; and
(c) adding one or more of La, Ce, and Nd to form complex oxides of La oxides, Ce oxides, and Nd oxides with Ti oxides, and one or more of cerium oxysulfite, lanthanum oxysulfite, and neodymium oxysulfite to fix the solute S in the molten steel, and
(d) continuously casting.

* * * * *

UNITED STATES PATENT AND TRADEMARK OFFICE

CERTIFICATE OF CORRECTION

PATENT NO. : 9,017,492 B2
APPLICATION NO. : 12/806971
DATED : April 28, 2015
INVENTOR(S) : Katsuhiro Sasai et al.

It is certified that error appears in the above-identified patent and that said Letters Patent is hereby corrected as shown below:

Specification

Column 2, line 54, change "Mn ≤ 0.01%" to -- Mn ≤ 0.1% --;

Column 3, line 16, change "S ≤ 0.0005% ≤ N ≤ 0.0025%," to -- S ≤ 0.01%, 0.0005% ≤ N ≤0.0025%, --; and

Claims

Column 11, line 16, claim 2, change "(a) adding A1 to 5 form preliminary deoxidation" to -- (a) adding A1 to perform preliminary deoxidation --.

Signed and Sealed this
Twenty-third Day of February, 2016

Michelle K. Lee

Michelle K. Lee
*Director of the United States Patent and Trademark Office*